US008833102B2

(12) United States Patent
Tsukamoto et al.

(10) Patent No.: US 8,833,102 B2
(45) Date of Patent: Sep. 16, 2014

(54) TURBO COMPRESSOR AND REFRIGERATOR

(75) Inventors: Minoru Tsukamoto, Yokohama (JP); Kentarou Oda, Yokohama (JP)

(73) Assignee: IHI Corporation (JP)

( * ) Notice: Subject to any disclaimer, the term of this patent is extended or adjusted under 35 U.S.C. 154(b) by 352 days.

(21) Appl. No.: 12/837,993

(22) Filed: Jul. 16, 2010

(65) Prior Publication Data

US 2011/0016913 A1 Jan. 27, 2011

(30) Foreign Application Priority Data

Jul. 21, 2009 (JP) ..... P2009-170192

(51) Int. Cl.

| | |
|---|---|
| ***F25B 43/02*** | (2006.01) |
| ***F04B 3/00*** | (2006.01) |
| ***F04D 29/58*** | (2006.01) |
| ***F04D 17/12*** | (2006.01) |
| ***F04D 25/02*** | (2006.01) |
| ***F04D 29/063*** | (2006.01) |

(52) U.S. Cl.

CPC ..... *F04D 25/02* (2013.01); *F04D 29/5826* (2013.01); *F04D 17/12* (2013.01); *F04D 29/063* (2013.01); *F04D 29/584* (2013.01)

USPC ..... 62/468; 62/84; 417/244

(58) Field of Classification Search

CPC ... F04D 25/00; F04D 25/062; F04D 25/0626; F04D 29/06

USPC ..... 62/84, 468, 469, 470, 472, 473, 510, 62/498; 415/159; 417/244, 423.1, 423.5, 417/423.8, 423.13, 366

See application file for complete search history.

(56) References Cited

U.S. PATENT DOCUMENTS

| | | | | |
|---|---|---|---|---|
| 3,853,433 | A * | 12/1974 | Roberts et al. | 417/423.13 |
| 5,606,872 | A * | 3/1997 | Terasaki | 62/471 |
| 5,647,315 | A * | 7/1997 | Saito | 123/196 AB |

FOREIGN PATENT DOCUMENTS

| | | |
|---|---|---|
| CN | 1104318 | 6/1995 |
| JP | 7-83526 | 3/1995 |
| JP | 2004-232481 | 8/2004 |

OTHER PUBLICATIONS

Chinese Office Action, dated Apr. 20, 2012, issued in corresponding Chinese Patent Application No. 201010232468.5. Total 10 pages, including English Translation.

* cited by examiner

*Primary Examiner* — Brandon M Rosati
*Assistant Examiner* — Jon T Schermerhorn
(74) *Attorney, Agent, or Firm* — Ostrolenk Faber LLP

(57) ABSTRACT

A turbo compressor includes a case; a plurality of compression stages which is disposed rotatably with respect to the case via sliding parts; an oil tank in which lubricant oils to be supplied to the sliding parts are stored; an oil cooler for cooling the lubricant oils; a primary piping for communicating the oil tank with the oil cooler; and a secondary piping for communicating the oil cooler with the sliding parts, wherein an accommodation space in which the oil cooler is accommodated is formed in the case, and the primary piping and the secondary piping are disposed within the case.

8 Claims, 3 Drawing Sheets

TURBO COMPRESSOR AND REFRIGERATOR

BACKGROUND OF THE INVENTION

1. Field of the Invention

The present invention relates to a turbo compressor and a refrigerator. More specifically, the present invention relates to a turbo compressor capable of compressing a fluid by a plurality of impellers and a refrigerator including the turbo compressor.

Priority is claimed on Japanese Patent Application No. 2009-170192, filed Jul. 21, 2009, the content of which is incorporated herein by reference.

2. Description of Related Art

As a refrigerator for cooling or refrigerating a material to be cooled such as water, there is known a turbo refrigerator or the like including a turbo compressor which compresses and discharges the refrigerant by means of a compressing means equipped with an impeller or the like. In the compressor, when the compression ratio increases, the discharging temperature of the compressor rises and the volumetric efficiency declines. Thus, in the turbo compressor included in the turbo refrigerator or the like as described above, the compression of the refrigerant is often performed so as to be divided into a plurality of stages.

In such a turbo compressor, an oil tank for storing lubricant oil, which is supplied to sliding parts of a compression means, is provided. The lubricant oil discharged from an oil pump or the like is led to an oil cooler disposed outside the compressor via an oil piping and is cooled, and is then supplied to the sliding parts such as the respective bearings (for example, see Japanese Unexamined Patent Application Publication No. 7-83526).

Incidentally, in the turbo compressor, an air-tightness test based on Article 7 (6) of Refrigeration Security Rule of High Pressure Gas Safety Act needs to be performed in Japan.

However, in the turbo compressor of the related art, the oil cooler or the oil piping is disposed outside the case of the compressor, whereby the piping is complicated and there are many types of joints, thus the air leakage is not inconsiderable. For this reason, there is a problem in that it is not necessarily easy to meet the standard of the air-tightness test.

SUMMARY OF THE INVENTION

The present invention provides a turbo compressor and a refrigerator which can easily achieve a high air-tightness property.

According to a first aspect of the present invention, a turbo compressor relating to the present invention includes a case, a plurality of compression stages disposed rotatably with respect to the case via sliding parts, an oil tank in which lubricant oil to be supplied to the sliding parts is stored, an oil cooler for cooling the lubricant oil, primary piping for connecting the oil tank with the oil cooler, and secondary piping for connecting the oil cooler with the sliding parts, wherein an accommodation space in which the oil cooler is accommodated is formed in the case and the primary piping and the secondary piping are disposed within the case.

In the turbo compressor, the primary piping, the secondary piping and the oil cooler through which the lubricant oil flows are disposed within the case of the turbo compressor. For this reason, it is possible to obtain the high air-tightness property without the need to consider air leakage or oil leakage from the piping. Thus, the standard of the air-tightness test can be surely met.

According to a second aspect of the present invention, in the turbo compressor relating to the present invention, at least a part of the primary piping and the secondary piping is formed within the case.

The turbo compressor can more preferably reduce the confirmation places of the air leakage or the oil leakage.

According to a third aspect of the present invention, a refrigerator relating to the present invention includes a condenser that cools and liquefies the compressed refrigerant, an evaporator which cools a material to be cooled by evaporating the liquefied refrigerant to take the vaporization heat from the material to be cooled, and a turbo compressor which compresses the refrigerant evaporated by the evaporator to supply the refrigerant to the condenser, wherein the above-mentioned turbo compressor is used as the turbo compressor.

The refrigerator exhibits the same working effects as the turbo compressor.

According to the present invention, the standard of the air-tightness test imposed on the turbo compressor can be easily and securely achieved.

DETAILED DESCRIPTION OF THE INVENTION

An embodiment of a turbo compressor and a refrigerator relating to the present invention will be described with reference to FIGS. 1 to 3.

Figure 1:
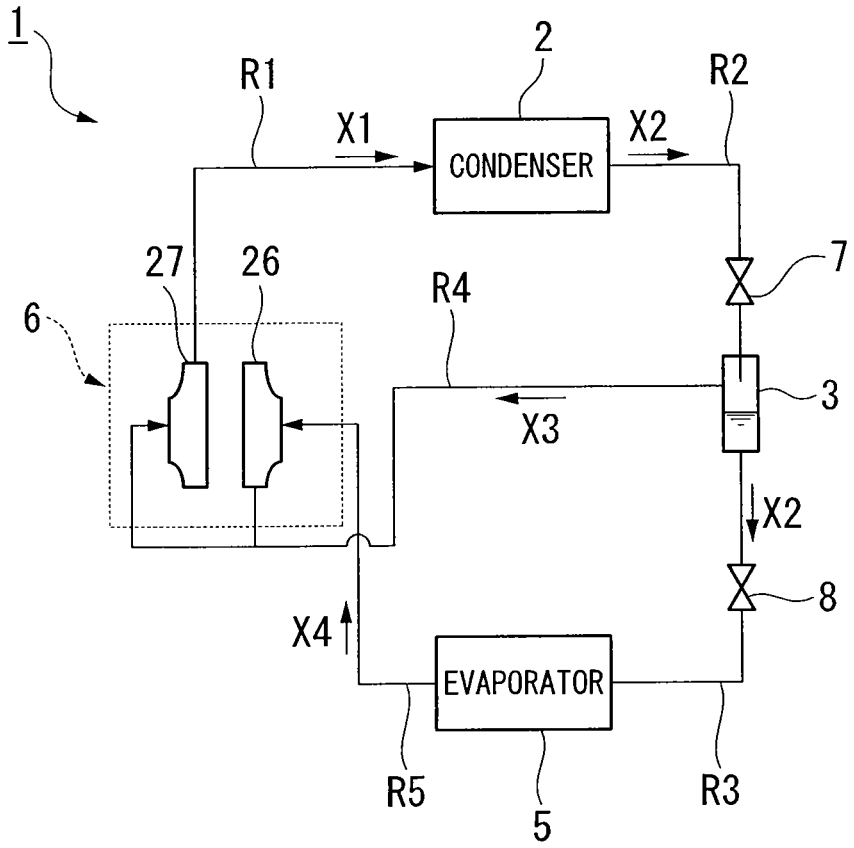
FIG. 1 is a block diagram showing a schematic configuration of a turbo refrigerator relating to an embodiment of the present invention.

As shown in FIG. 1, a turbo refrigerator (a refrigerator) 1 is, for example, installed in a building or a factory so as to create the cooling water for air conditioning, and includes a condenser 2, an economizer 3, an evaporator 5 and a turbo compressor 6.

The condenser 2 is supplied with a compressed refrigerant gas X1, which is a refrigerant (a fluid) compressed in a gas state, and makes the compressed refrigerant gas X1 a refrigerant liquid X2 by cooling and liquefying the compressed refrigerant gas X1.

As shown in FIG. 1, the condenser 2 is connected to the turbo compressor 6 via a flow path R1 through which the compressed refrigerant gas X1 flows. In addition, the condenser 2 is connected to the economizer 3 via a flow path R2 through which the refrigerant liquid X2 flows. An expansion valve 7 for decompressing the refrigerant liquid X2 is installed in the flow path R2.

The economizer 3 temporarily stores the refrigerant liquid X2 which has been decompressed in the expansion valve 7. The economizer 3 is connected to the evaporator 5 via a flow path R3 through which the refrigerant liquid X2 flows. Furthermore, the economizer 3 is connected to the turbo compressor 6 via a flow path R4 through which gaseous components X3 of the refrigerant generated in the economizer 3 flow. An expansion valve 8 for further decompressing the refrigerant liquid X2 is installed in the flow path R3. The flow path R4 is connected to the turbo compressor 6 so as to supply the gaseous components X3 to a second compression stage 27 described below which is included in the turbo compressor 6.

The evaporator 5 cools the material to be cooled, such as water, by evaporating the refrigerant liquid X2 to take the vaporization heat from the material to be cooled. The evaporator 5 is connected to the turbo compressor 6 via a flow path R5 through which a refrigerant gas X4 generated by the evaporation of the refrigerant liquid X2 flows. The flow path R5 is connected to a first compression stage 26 described below which is included in the turbo compressor 6.

The turbo compressor 6 compresses the refrigerant gas X4 to make it the compressed refrigerant gas X1. As described above, the turbo compressor 6 is connected to the condenser 2 via the flow path R1 through which the compressed refrigerant gas X1 flows and is connected to the evaporator 5 via the flow path R5 through which the refrigerant gas X4 flows.

Figure 2:
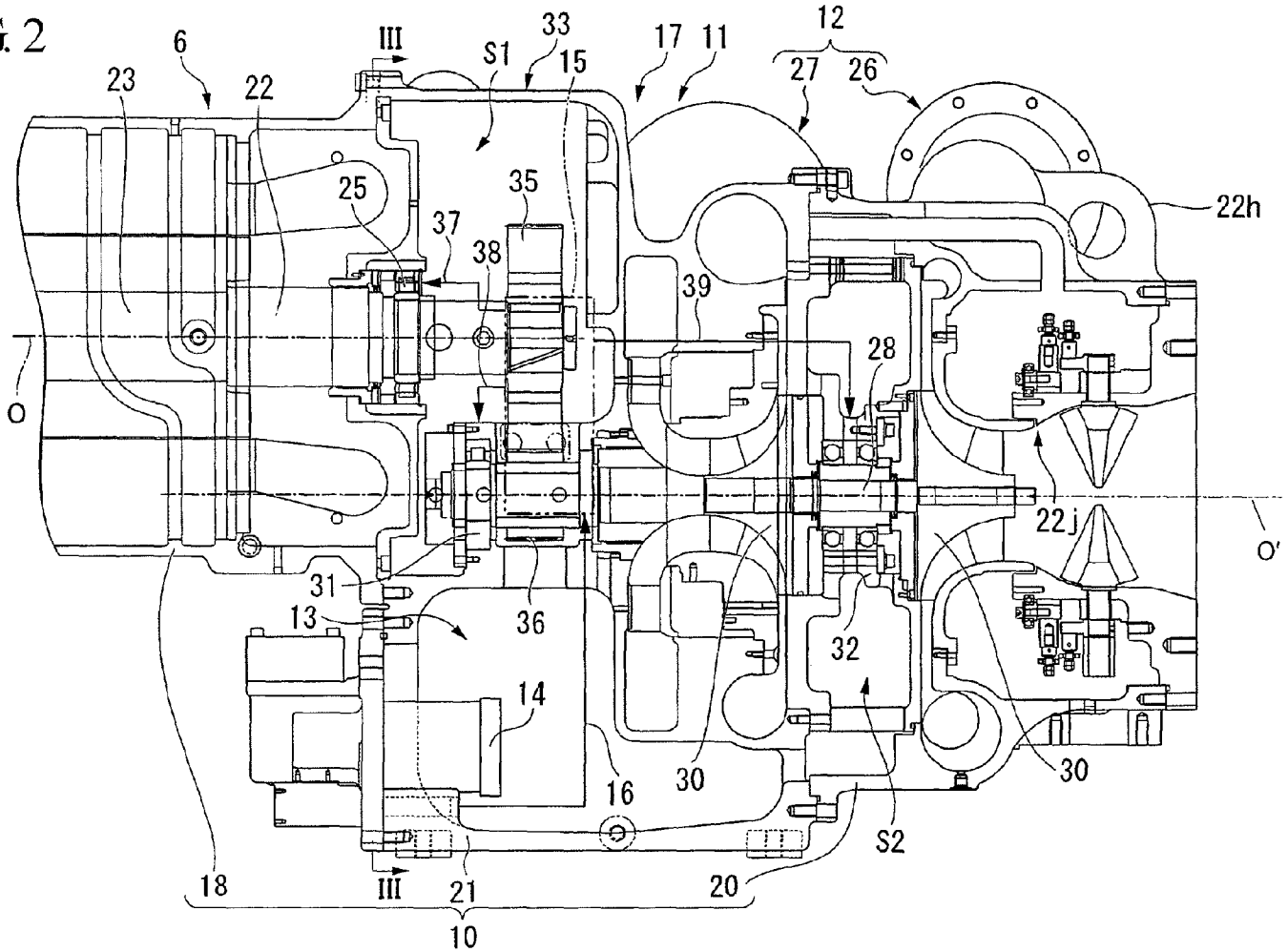
FIG. 2 is a vertical sectional view of a turbo compressor included in the turbo refrigerator relating to an embodiment of the present invention.
Figure 3:
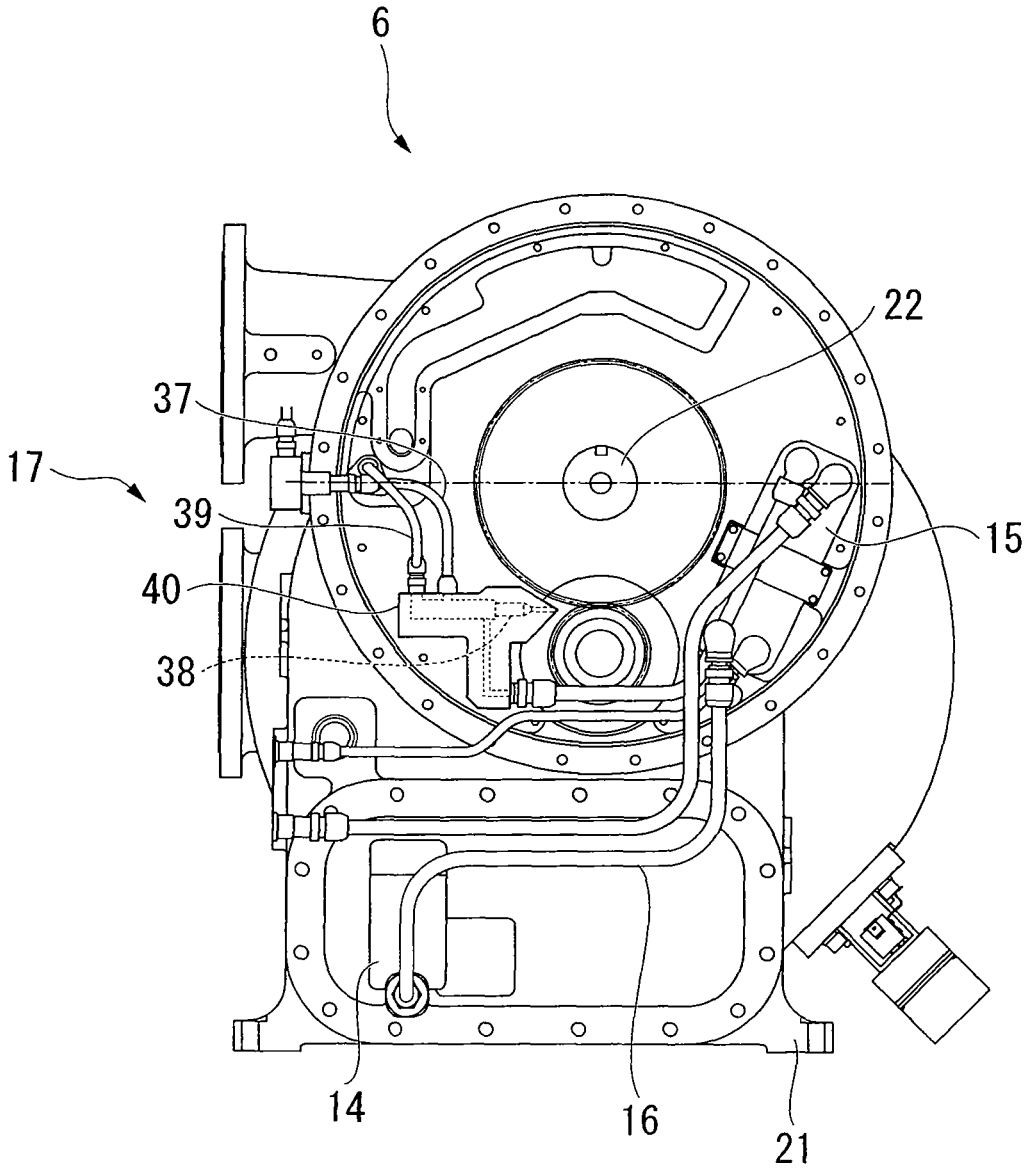
FIG. 3 is a sectional view taken from lines III-III in FIG. 2.

As shown in FIGS. 2 and 3, the turbo compressor 6 includes a case 10, a plurality of compression stages 12 which are disposed rotatably with respect to the case 10 via sliding parts 11, an oil tank 13 in which lubricant oil to be supplied to the sliding parts 11 is stored, an oil cooler 15 for cooling the lubricant oil, primary piping 16 for connecting the oil tank 13 with the oil cooler 15, and secondary piping 17 for connecting the oil cooler 15 with the sliding parts 11.

In FIG. 2, in order to facilitate the understanding of the primary piping 16 and the secondary piping 17, they are schematically shown.

The case 10 is divided into a motor housing 18, a compressor housing 20 and a gear housing 21, and those parts are connected to each other in a separable manner. In the motor housing 18, an output shaft 22 which rotates around an axis O, and a motor 23, which is connected to the output shaft 22 to drive the compression stages 12, are disposed. The output shaft 22 is rotatably supported by a first bearing 25 fixed to the motor housing 18.

The compression stages 12 include a first compression stage 26 which sucks and compresses the refrigerant gas X4 (see FIG. 1), and a second compression stage 27 which further compresses the refrigerant gas X4 compressed in the first compression stage 26 to discharge the refrigerant gas X4 as the compressed refrigerant gas X1 (see FIG. 1). The first compression stage 26 is disposed in the compressor housing 20. The second compression stage 27 is disposed in the gear housing 21.

The respective compression stages 26 and 27 include a plurality of impellers 30 which are fixed to a rotational shaft 28 and are driven for rotation around the axis O'. The rotational shaft 28 is rotatably supported by means of a second bearing 31 fixed to the gear housing 21 and a third bearing 32 fixed to the compressor housing 20.

In the gear housing 21, an accommodation space S1, in which a gear unit 33 for transmitting the driving force of the output shaft 22 to the rotational shaft 28 is accommodated, is formed. The oil cooler 15 is accommodated in the accommodation space S1. In the oil cooler 15, a refrigerant piping is disposed so that the refrigerant is supplied from the outside and is discharged to the outside.

The oil tank 13 is disposed under the accommodation space S1. The oil tank 13 also communicates with a space S2 formed within the compressor housing 20.

The gear unit 33 includes a low speed gear 35 fixed to the output shaft 22 of the motor 23, and a high speed gear 36 which is fixed to the rotational shaft 28 and is engaged with the low speed gear 35. In addition, the rotational movement force of the output shaft 22 of the motor 23 is transmitted to the rotational shaft 28 such that the rotational speed of the rotational shaft 28 is greater than the rotational speed of the output shaft 22.

The primary piping 16 and the secondary piping 17 are disposed inside the gear housing 21. As described above, the primary piping 16 is piping for connecting the oil tank 13 with the oil cooler 15. Specifically, the primary piping 16 is piping for connecting the oil pump 14 accommodated within the oil tank 13 with the oil cooler 15.

The secondary piping 17 is piping for connecting the oil cooler 15 with the sliding parts 11. The sliding parts 11 include the first bearing 25, the second bearing 31, the third bearing 32 and the gear unit 33.

In particular, the secondary piping 17 includes first piping 37 for supplying the first bearing 25 with lubricant oil, second piping 38 for supplying the second bearing 31 with lubricant oil, third piping 39 for supplying the third bearing 32 with lubricant oil, and gear piping (not shown) for supplying the gear unit 33 with lubricant oil.

Furthermore, the secondary piping 17 the oil cooler 15 to a manifold 40 disposed in the accommodation space S1, and then the secondary piping 17 is respectively divided into the first piping 37, the second piping 38, the third piping 39 and the gear piping.

Next, the operation of the turbo refrigerator 1 and the turbo compressor 6 relating to the present embodiment will be described.

First of all, the lubricant oil is supplied from the oil tank 13 to the oil cooler 15 via the primary piping 16 by means of an oil pump 14. In addition, the lubricant oil, which was subjected to the heat exchange and cooled by the oil cooler 15, is supplied to the sliding parts 11 via the first piping 37, the second piping 38, the third piping 39 and the gear piping which are included in the secondary piping 17.

Then, the motor 23 is driven, so that the rotational movement force of the output shaft 22 of the motor 23 is transmitted to the rotation shaft 28 via the gear unit 33. As a result, the first compression stage 26 and the second compression stage 27 are driven for rotation.

When the first compression stage 26 is driven for rotation, the refrigerant gas X4 from the flow path R5 flows into the first compression stage 26. The refrigerant gas X4 that flows into the first compression stage 26 is imparted with the speed energy by the impeller 30 and is discharged from the axis O' direction in the radial direction.

The refrigerant gas X4 discharged from the first compression stage 26 is compressed by converting the speed energy thereof to the pressure energy, whereby the refrigerant gas X4 is supplied to the second compression stage 27.

Similarly to the first compression stage 26, the refrigerant gas X4 supplied to the second compression stage 27, is imparted with the speed energy by the impeller 30 and is discharged from the axis O' direction in the radial direction. The speed energy of refrigerant gas X4 discharged from the second compression stage 27 is converted to the pressure energy, so that the refrigerant gas X4 is further compressed to produce the compressed refrigerant gas X1. In addition, the compressed refrigerant gas X1 led to the outside of the second compression stage 27 is supplied to the condenser 2 via the flow path R1.

On the other hand, the lubricant oil which was supplied to the accommodation space S1 and the space S2 and which flowed down from the sliding parts 11 is collected to the oil tank 13.

In the turbo compressor 6 relating to the present embodiment, the accommodation space S1, in which the oil cooler 15 is accommodated, is formed within the case 10, and the primary piping 16 and the secondary piping 17 are disposed within the case 10. For this reason, a high air-tightness property can be obtained without the need to consider air leakage or oil leakage from the piping. Thus, it is possible to easily and surely meet the standard of the air-tightness test imposed on the turbo compressor 6.

Furthermore, the technical scope of the present invention is not limited to the above-mentioned embodiment, but various modifications can be added without departing from the gist of the present invention.

For example, the shapes of the primary piping 16 and the secondary piping 17 are not limited to those relating to the present embodiment, but at least a part of the primary piping and the secondary piping may be formed so as to be embedded into the wall surface of the case. As a result, it is possible to more preferably reduce the confirmation places of the air leakage or the oil leakage.

Furthermore, in the above-mentioned embodiments, although the configuration including the two compression stages (the first compression stage 26 and the second compression stage 27) has been described, the present invention is not limited thereto, but a configuration including one or three or more compression stages may be adopted.

In addition, the turbo compressor 6, in which the motor housing 18, the compressor housing 20 and the gear housing 21 are each dividedly formed as the case 10, has been described. However, the present invention is not limited thereto, but, for example, a configuration, in which the motor is disposed between the first compression stage and the second compression stage, may be adopted.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A turbo compressor comprising:

a case divided into a motor housing, a gear housing, and a compressor housing;

a plurality of compression stages which are disposed rotatably with respect to the case via sliding parts, each of the plurality of compression stages including an impeller;

an oil tank disposed in the gear housing, lubricant oil to be supplied to the sliding parts being stored in the oil tank;

a motor in the motor housing for rotating the plurality of the impellers included in the plurality of the compression stages via the sliding parts;

an oil cooler for cooling the lubricant oil;

primary piping connecting the oil tank with the oil cooler; and secondary piping connecting the oil cooler with the sliding parts, wherein the gear housing includes an accommodation space which is located above the oil tank and configured to communicate with the oil tank, and the accommodation space is configured to accommodate a first part of the sliding parts, the oil cooler, part of the primary piping, and part of the secondary piping.

2. The turbo compressor according to claim 1, wherein at least a part of the primary piping and the secondary piping is embedded into a wall surface of the case.

3. A refrigerator comprising:

a condenser that cools and liquefies a compressed refrigerant;

an evaporator which cools a material to be cooled by evaporating a liquefied refrigerant to take a vaporization heat from the material to be cooled; and a turbo compressor which compresses a refrigerant evaporated by the evaporator to supply the refrigerant to the condenser, wherein the turbo compressor according to claim 1 is used as the turbo compressor.

4. A refrigerator comprising:

a condenser that cools and liquefies a compressed refrigerant;

an evaporator which cools a material to be cooled by evaporating a liquefied refrigerant to take a vaporization heat from the material to be cooled; and a turbo compressor which compresses a refrigerant evaporated by the evaporator to supply the refrigerant to the condenser, wherein the turbo compressor according to claim 2 is used as the turbo compressor.

5. The turbo compressor according to claim 1, wherein the sliding parts include:

a first bearing which is fixed to the motor housing and configured to rotatably support an output shaft of the motor, a second bearing which is fixed to the gear housing and configured to rotatably support a rotational shaft of the plurality of the impellers via one end of the rotational shaft, a third bearing which is fixed to the compressor housing and configured to rotatably support the rotational shaft of the plurality of the impellers via the other end of the rotational shaft, and a gear unit which includes one gear fixed to the output shaft of the motor and another gear fixed to the rotational shaft of the plurality of the impellers, and wherein the secondary piping includes:

a first piping which is configured to supply the lubricant oil to the first bearing, a second piping which is configured to supply the lubricant oil to the second bearing, and a third piping which is configured to supply the lubricant oil to the third bearing.

6. The turbo compressor according to claim 5, wherein the compressor housing includes a space formed therein, and the space is configured to accommodate the third bearing.

7. The turbo compressor according to claim 6, wherein the oil tank is configured to communicate with the space formed in the compressor housing.

8. The turbo compressor according to claim 1, wherein the oil tank is configured to communicate with a space which is configured to accommodate a second part of the sliding parts.

* * * * *